United States Patent [19]

Takenaka et al.

[11] Patent Number: 4,994,704

[45] Date of Patent: Feb. 19, 1991

[54] CATHODE RAY TUBE AND AN ENVELOPE THEREFOR

[75] Inventors: Shigeo Takenaka; Takashi Nishimura, both of Saitama, Japan

[73] Assignee: Kabushiki Kaisha Toshiba, Kawasaki, Japan

[21] Appl. No.: 413,583

[22] Filed: Sep. 28, 1989

[30] Foreign Application Priority Data

Nov. 16, 1988 [JP] Japan ..... 63-287522

[51] Int. Cl.[5] ..... H01J 29/86

[52] U.S. Cl. ..... 313/2.1; 313/477 R; 313/482; 220/2.1 A; 220/2.3 A

[58] Field of Search ..... 313/2.1, 477 R, 482; 220/2.1 A, 2.3 A

[56] References Cited

U.S. PATENT DOCUMENTS 4,712,038 12/1987 Takenaka et al. ..... 313/2.1
4,714,856 12/1987 Takenaka et al. ..... 313/2.1
4,792,720 12/1988 Takenaka et al. ..... 313/409

*Primary Examiner*—Kenneth Wieder

*Attorney, Agent, or Firm*—Oblon, Spivak, McClelland, Maier & Neustadt

[57] ABSTRACT

A color cathode ray tube includes a vacuum envelope including a panel having a single glass faceplate including an inner surface and central axis and a skirt extending from the faceplate, a rear metal plate hermetically connected to the skirt through a first connecting member, a plurality of funnels coupled to the rear plate through a second connecting member, and a plurality of necks respectively extending from the funnels. In the vacuum envelope, are provided a plurality of electron gun assemblies respectively received in the necks for emitting a plurality of electron beams, a screen formed on the inner surface of the faceplate for emitting visible light by excitation of the electron beams from the electron gun assemblies, and a mask received in the vacuum envelope so as to face to the screen and having an effective region for allowing passage of the electron beams to impinge on the screen. The first connecting member has stabilizing means for absorbing strain caused by difference between a thermal expansion amount of the rear plate and that of the panel.

18 Claims, 7 Drawing Sheets

CATHODE RAY TUBE AND AN ENVELOPE THEREFOR

BACKGROUND OF THE INVENTION

This invention relates to a cathode ray tube and more particular, to an envelope for a cathode ray tube of a multinecks structure.

Color cathode ray tubes for large-sized, high brightness, high resolution color TV receives for use in high definition TV systems, or for large-sized, high resolution graphic display units for use in computer terminals, demand specification requirements differing from those for color cathode ray tubes applicable to general consumer applications. Various investigations have been carried out to satisfy these specification requirements.

A high brightness and a high resolution shadow mask color cathode ray tube with a small-sized screen are at present commercially available. However, the tube with a large-sized screen having a sufficient high degree of brightness and resolution have not been commercially realized. The main reason for this shortcoming can be attributed to the increase in the magnification factor of the electron-optics of the electron gun which would necessarily accompany any extend tube depth due to possible increases in tube dimensions. There is a reduction in the electron beam energy intensity on the screen surface as a result of any screen enlargement.

In order to settle such drawback, a color cathode ray tube of a multinecks structure with a high resolution and brightness has been proposed in U.S. Pat. Nos. 4,712,038, 4,714,856 and 4,792,720. The multinecks color cathode tube is illustrated in FIG. 1 showing a cross-sectional view of the tube. In the tube 1, a vacuum envelope 2 includes a panel 3 composed of a single faceplate 4 with a rectangular inner surface and a skirt 5 extending parallel to a central axis Z from a periphery of the faceplate 4, a funnel 6 hermetically connected to the skirt 5 at its end and a plurality of necks 7*a*, 7*b*, 7*c* and 7*d*. In each necks 7*a*, 7*b*, 7*c* and 7*d*, each electron gun assemblies 8*a*, 8*b*, 8*c* and 8*d* is provided for emitting three electron beams 9*a*, 9*b*, 9*c* and 9*d*. In the drawing, three electron beams are illustrated by a single line for simplification, respectively. A phosphor screen 10 is formed on the inner surface of the faceplate 4 for reproducing color image by exitation of the electron beams 9*a*, 9*b*, 9*c* and 9*d*. A mask 11 with a plurality of apertures allowing a passage of the electron beams is provided in the panel 3 by support of a mask frame 12 so as to have predetermined distance between the phosphor screen 10 and the mask 11.

During an operation of the tube mentioned above, the electron beams 9*a*, 9*b*, 9*c* and 9*d* are deflected by deflection yoke 13*a*, 13*b*, 13*c* and 13*d* so as to scan the first, second third and fourth regions 10*a*, 10*b*, 10*c* and 10*d* of the phosphor screen 10, respectively.

As seen from FIG. 1, since the envelope 2, especially, the funnel 6 has a complex configuration, it is difficult for forming it, and consequently, the envelope 2 is not suitable for mass production. Namely, it is necessary to have a circular openings 14*a*, 14*b*, 14*c* and 14*d* for hermetically connecting to the necks 8*a*, 8*b*, 8*c* and 8*d*, respectively. In addition, walls 15*a*, 15*b*, 15*c*, 15*d* and 15*e*, which confine the respective opening 14*a*, 14*b*, 14*c* and 14*d*, should be inclined so as to allow the passage of the electron beams 9*a*, 9*b*, 9*c* and 9*d* from the electron gun assemblies 8*a*, 8*b*, 8*c* and 8*d* toward the phosphor screen 10, respectively. Further, it is difficult to correctly and hermetically connect the necks 7*a*, 7*b*, 7*c* and 7*d* to the walls 15*a*, 15*b*, 15*c*, 15*d* and 15*e* of the funnel 6 at the openings 14*a*, 14*b*, 14*c* and 14*d*, respectively, in order that the electron beams correctly land the phosphor screen region.

Furthermore, as the size of the envelope 2 is increased, it is necessary to make glass thickness of the funnel 6 almost as thick as glass thickness of the panel 3 in order to maintain the strength against atmospheric pressure. On the other hand, the necks 7*a*, 7*b*, 7*c* and 7*d*, which are hermetically connected to the funnel 6, is made of glass of which thickness is normally very thin at about 1 mm. The heat distribution from the funnel 6 to the necks 7*a*, 7*b*, 7*c* changes abruptly. Consequently, the heat strain in the multiple heating processes which are undergone during the manufacturing process of the tube increases and the envelope tends to be broken at the connection between the neck and the funnel. Therefore, the envelope with the construction mentioned above is unsuitable for mass-production.

As an envelope for a flat panel display device. U.S. Pat. No. 4,325,489 discloses the envelope which is suitable for production of the display device. The envelope comprises a baseplate and a faceplate held in a spaced parallel relationship by a plurality of sidewalls and a plurality of support walls formed by vanes and vane tips. The support walls support he baseplate and faceplate against atmospheric pressure and divide the envelope into a plurality of longitudinally extending channels. The envelope also includes a flexible seal with a space which accommodates for dimensional difference between the sidewalls and support walls.

The flexible seal is composed of a pair of continous members which are fritted to the faceplate of glass and the sidewalls of metal, respectively. Since the members are flexible and deformed without rupturing the weld along a seam of the members, stress in the frits due to different thermal expansion coefficient can be minimized.

The larger the screen size of the cathode ray tube, the more difference of thermal expansion amount between the faceplate and the sidewalls. Since the flexible seal is not sufficient for compensation of the increased difference of the thermal expansion amount in the case of the tube with the large screen, cracks will occure at frit sealing portion.

SUMMARY OF THE INVENTION

An object of this invention is to provide a color cathode ray tube with a high quality.

Another object of the invention is to provide a color cathode ray tube which are suitable for mass-production.

Further object of the invention is to provide a color cathode ray tube which are hard to receive heat strain in a vacuum envelope of the tube during heating process.

Therefore, the invention may provide a color cathode ray tube comprising a vacuum envelope including a panel having a single glass faceplate including an inner surface and a central axis, and a skirt extending form the faceplate, a rear metal plate hermetically connected to the skirt through a first connecting means, a plurality of funnels hermetically coupled to the rear plate through a second connecting means and a plurality of necks respectively extending form the funnels, a plurality of electron gun assemblies respectively received in the necks for emitting a plurality of electron beams, a screen formed on the inner surface of the faceplate for emitting visible light by excitation of the electron beams from the electron gun assemblies, a mask received in the vacuum envelope so as to face to the screen and having an effective region for allowing passage of the electron beams to impinge on the screen.

At least one of the first and second connecting means have stabilizing means for absorbing strain caused by difference between a thermal expansion amount of the rear plate and that of the panel and the difference between a thermal expansion amount of the rear plate and that of the funnel, respectively.

According to the invention, by using the first and second connecting means for hermetically connecting the panel to the rear plate and hermetically connecting the rear plate to the necks, respectively, can be realized the cathode ray tube which includes the rear plate with a simple structure compared with a funnel of the conventional cathode ray tube. Due to the rear plate bridging the panel to the funnels, the cathode ray tube is extremely suitable for mass production.

Further, since the first and second connecting means, which can stabilize each of strain caused by difference between thermal expansion amount of the panel and that of the rear plate and difference between thermal expansion amount of the rear plate and that of the necks, respectively, are used for connecting the two those of the panel, the rear plate and the necks through the funnels, the cathode ray tube can be prevented from destruction when large difference between thermal expansion amount of the panel of glass and that of the rear plate of metal has been occured during passage of heating process. Therefore, accidental destruction of the tubes during tube manufacturing process has been remarkably decreased.

Furthermore, since the tube includes the first and second connecting means, the rear plate, which bridges the panel and the necks made of glass through the funnels, can be made of mild steel which is cheaper than a sealing alloy. As the result, the price of the tube can be reducted.

DETAILED DESCRIPTION OF PREFERRED EMBODIMENT

Figure 1:
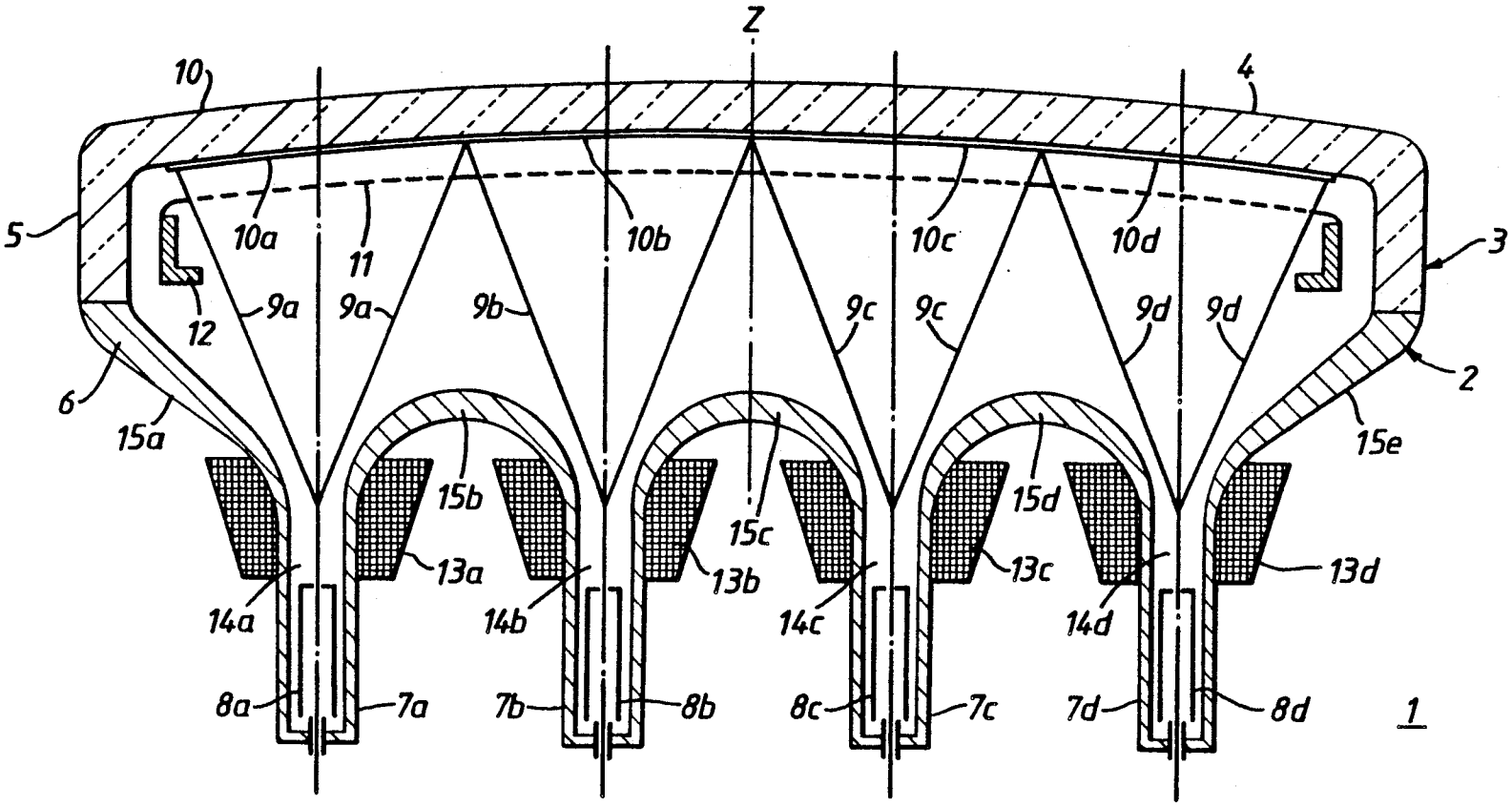
Fig. 1. PRIOR ART
FIG. 1 shows a cross-sectional view of a conventional multineck color cathode ray tube.
Figure 2:
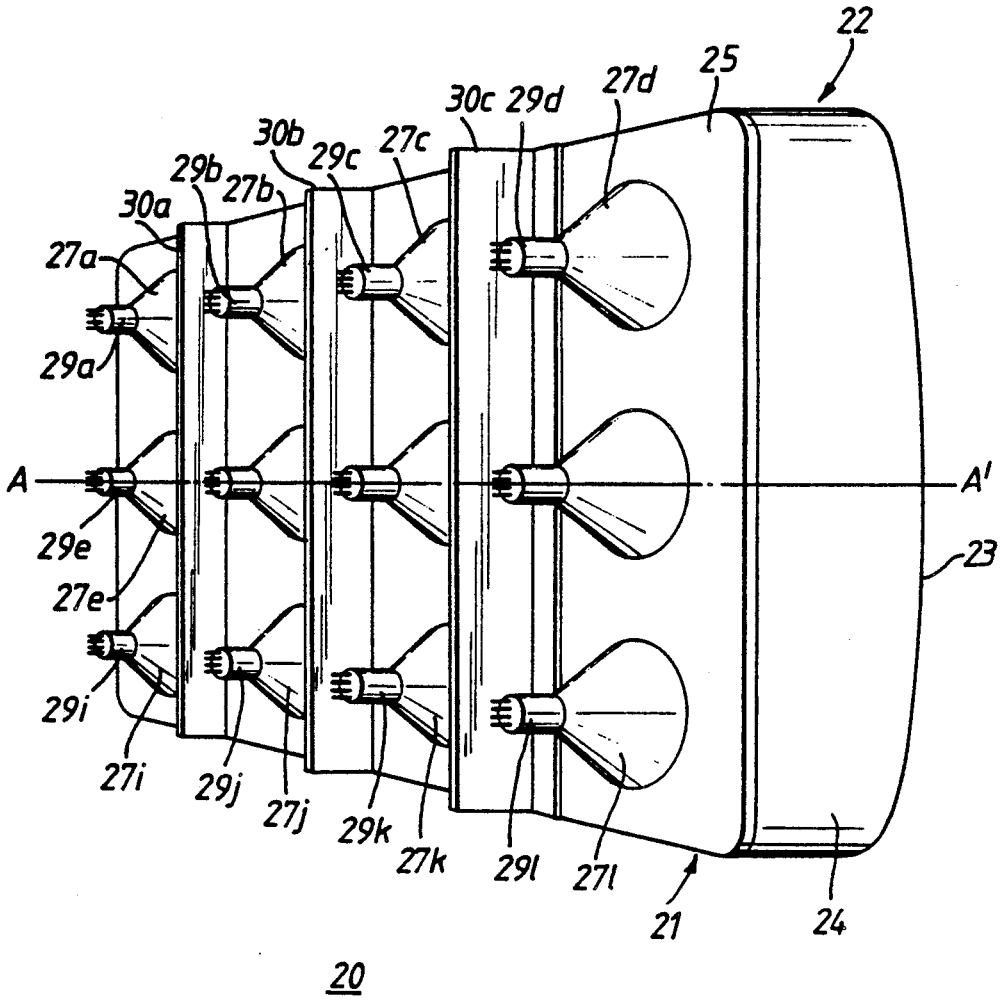
FIG. 2 shows a perspective view of a color cathode ray tube in accordance with preferred embodiment of the invention.
Figure 3:
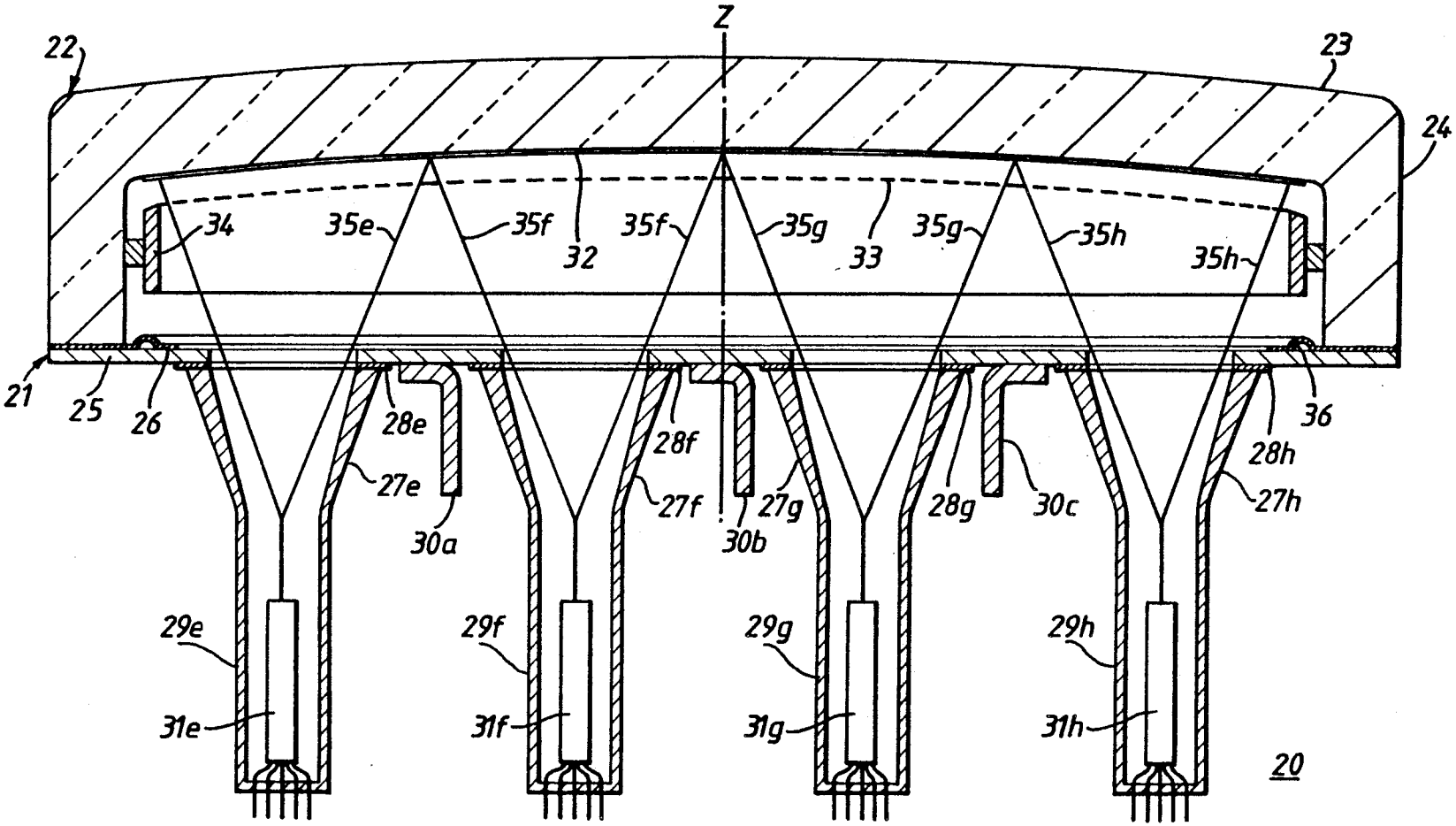
FIG. 3 shows a cross-sectional view of the color cathode ray tube shown in FIG. 2.

Preferred embodiment of this invention will be explained with reference to the accompanying drawings. In FIGS. 2 and 3, a color cathode ray tube 20 with a multinecks structure includes an vacuum envelope 21. The envelope 21 includes a panel 22, which is composed of a single glass faceplate 23 with roughly rectangular shape and a glass skirt 24 extending from the periphery of the faceplate 23 approximately parallel to a center axis Z of the faceplate 23, a rear metal plate 25, which is hermetically connected to the skirt 24 through a first connecting member 26 with a shape of an annular ring and has a main surface approximately parallel to the faceplate 23, twelve glass funnels 27*a*, 27*b*, . . . and 27*l*, each of which has a conical shape and is hermetically connected to the rear plate 25 through a corresponding second connecting member, four of which are shown in FIG. 3 as 28*e*, 28*f*, . . . and 28*h* with a shape of annular ring, and twelve glass necks 29*a*, 29*b*, . . . and 29*l*, which are hermetically connected to the funnels 27*a*, 27*b*, . . . and 27*l*, respectively. In the envelope 21, reinforcement plate 30*a*, 30*b* and 30*c*, each of which has a main surface approximately perpendicular to the main surface of the rear plate 25, are provided for reinforcement of the rear plate 25.

Figure 4:
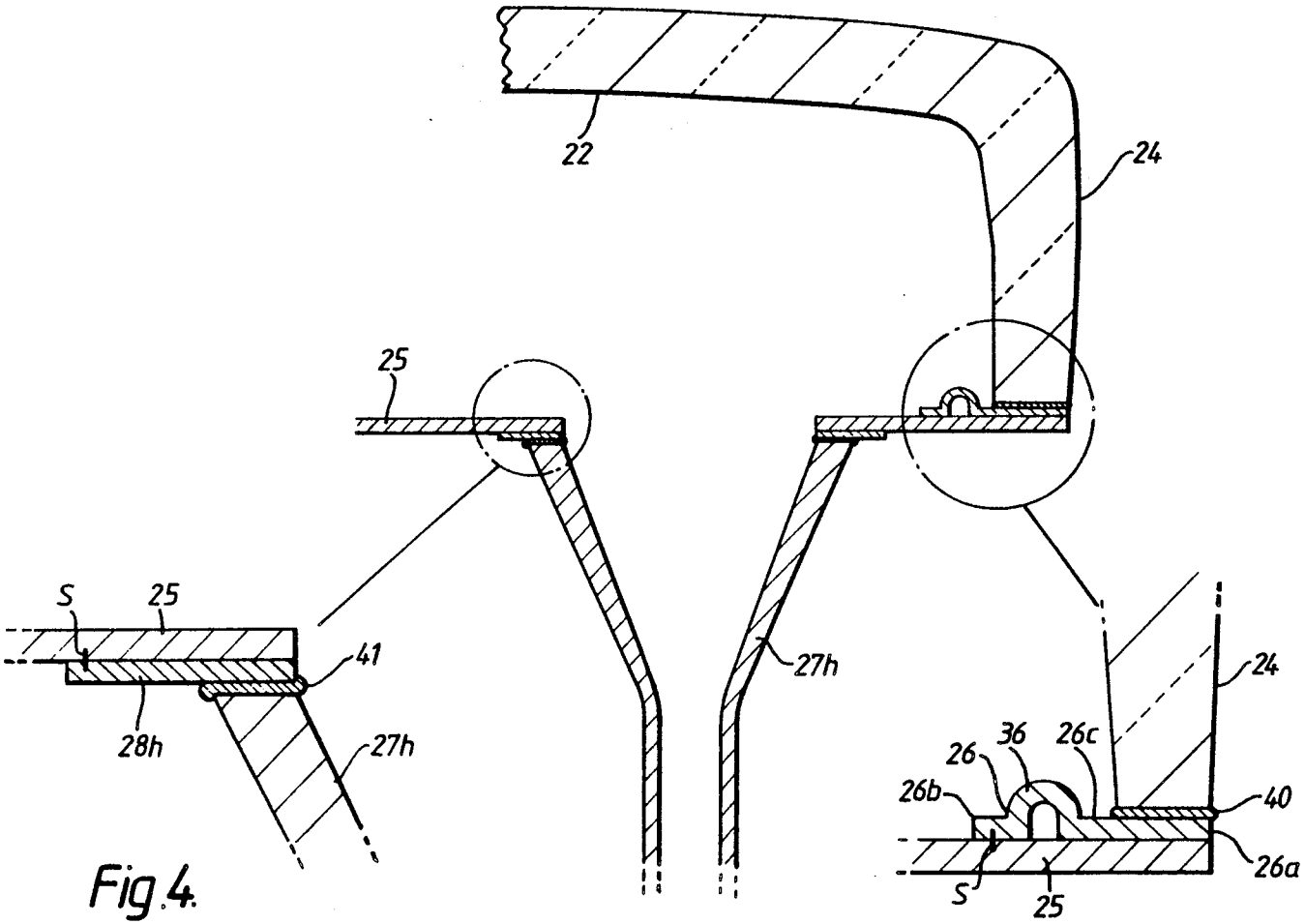
FIG. 4 shows a cross-sectional view of an enlargement of first and second connecting members.

The cathode ray tube 20 also includes twelve electron gun assemblies of which are shown in FIG. 4 as 31*e*, 31*f*, . . . and 31*h*, which are received in the necks 29*a*, 29*b*, . . . and 29*l* for emitting three electron beams, respectively, a phosphor screen 32, which composed of a plurality of three kinds of phosphor stripes for emitting respective light of red, green and blue, a shadow mask 33, which has a plurality of apertures and is positioned so as to have a predetermined distance to the phosphor screen 32, and a mask frame 34 supporting the shadow mask 33. During operation of the cathode ray tube 20, respective electron gun assemblies emit three electron beams four of which are shown in FIG. 3 as 35*e*, 35*f*, . . . and 35*h* in response to picture signals corresponding to each color. The electron beams scan a specified area of the phosphor screen 32. In the case of this embodiment, the phosphor screen 32 is divided into a total of 12 specified areas, 3 specified areas vertically and 4 specified areas horizontally.

Since this type of color picture tube can be regard as similar to the case of multiple small size color picture tubes which are arranged in series, the picture quality, that is to say the convergence and resolution (spot diameter of an electron beam on the screen), is same as that in a small size color picture tube and is superior to that of a normal size color picture tube.

The envelope 21 of the tube 20 is explained, in detail. The faceplate has a inner surface of which size is enough for forming the phosphor screen 32 with a size of 609.6 mm×457.2 mm. The hight of the skirt 24 is about 115 mm. The panel 22, which is composed of the faceplate 23 and the skirt 24, is made of soft glass. The first connecting member 26 is a ring-shaped thin metal plate of width 30 mm, of which the outer periphery is roughly the same shape as that of the outer periphery of the skirt 24. The member 26 is made of a sealing alloy consisting of 50% nickel alloy with a thickness of 0.1 mm. The member 26 also has an annular projection 36 with a radius approximately 4 mm inside the skirt 24 for absorbing strain caused by difference between thermal expansion amount of the skirt 24 and that of the rear plate 25 by deformation of the projection 36.

The rear plate 25 with twelve openings is made of mild steel with a thickness of 2 mm and has an outer periphery which is roughly the same as these of the outer periphery of the skirt 24.

The second connecting members 28*a*, 28*b*, . . . and 28*l* are ring-shaped thin metal plate of width 5 mm, respectively. Each member is made of a sealing alloy consisting of 50% nickel alloy with a thickness of 0.2 mm.

Each of the funnels 27*a*, 27*b*, . . . and 27*l* has a conical shape with a diagonal length of the wider end opening of approximately 50 mm and is hermetically connected to each neck 29*a*, 29*b*, . . . and 29*l* of an external diameter 22.5 mmϕ. The funnels 27*a*, 27*b*, . . . and 27*l* and the necks 29*a*, 29*b* , . . . and 29*l* are made of soft glass.

The shapes of the openings of those of the rear plate 25, the inner periphery of the second connecting members 28*a*, 28*b*, . . . and 28*l* and the inner periphery of the funnels 27*a*, 27*b*, . . . and 27*l* are roughly the same so as to be hermetically connected to each other.

The reinforcement plates 30*a*, 30*b*, and 30*c* fixed to the rear plate 25 are made of mild steel of thickness 2.0 mm and have a hight of 40 mm, respectively.

Next, with reference to FIG. 4, the bonding method for the panel 22, the rear plate 25 and the funnel 27 through the first and second connecting members 26 and 28 is explained below.

In the envelope 21 of the cathode ray tube 20 according to the embodiment, frit sealing is used for a seal of glass-metal and seam welding is also used for a seal of metal-metal. Namely, the end of the skirt 24 and a first flat portion 26*a* of the first connecting member 26 are hermetically connected each other by a frit glass layer 40. Also, the end of the funnel 27*h* and one surface of the second connecting member 28*h* are hermetically connected each other by a second frit glass layer 41. The bonding by the frit glass layer was completed by heating at the temperature of about 450° C. for 1 hour. For increasing the bonding strength of the bonding between the frit glass layers 40 and 41 and the first and second connecting members 26 and 28*h*, respectively, oxide layers were formed on the surface portions of the first and second members 26 and 28*h* where the frit glass layer 40 and 41 are bonded to, respectively.

After bonding as mentioned above, since thermal expansion coefficient of the first and second connecting member 26 and 28*h* are $99.0\times10^{-7}$/°C., and that of the panel 22 and funnel 27*h* are $100\times10^{-7}$/°C., residual strain was negligibly small.

Further, a second flat portion 26*b* of the first connecting member 26 and the second member 28*h* were bonded to the rear plate 25 by seam welding. For the welding, it is preferable to separate the positions where welding is carried out as far as possible from the bonding position where the frit sealing is carried out in order to prevent peeling of the frit glass layer due to the thermal deformation caused by the heat during the welding.

Although resistance welding is used for the welding of the rear plate 25 to the first and second connecting members 26 and 28*h* in this embodiment, any welding can be applicable, such as plasma welding, laser welding, ultrasonic welding.

The first connecting member 26 has a third flat portion 26*c* to isolate the projection 36 from the first flat portion 26*a* sealed to the skirt 24. The third flat portion 26*c* is hard to be deformed by strain caused by the difference between a thermal expansion amount of the rear plate 25 and that of the panel 21, comparing with deformability of the projections 36.

Further, the principle of operation of the first and second connecting members is explained. Since the principle of operation of both members are the same, explanation regarding the first connecting member is made with reference to FIGS. 5 and 6.

If the thermal expansion coefficient of all parts constructing the envelope of the tube are same and the thermal capacity of the parts are also equal, no strain would remain in any part after connecting, and thus there would be spontaneous breakage.

In the case of bonding the glass member to the metal member, the strength of glass to resist the strain due to bonding is weaker than that of metal, in particular, tensile strength of glass is very weak. On the other hard, since the strength of the metal to resist the strain is much stronger than that of the glass, the metal member is hardly broken under the strain.

It can be considered that there are two main causes of the breakage of the glass member due to the bonding. One cause is a difference between thermal expansion coefficient of glass and that of the metal. Another cause is a difference between thermal expansion amount (or thermal contraction amount) of the glass member and that of the metal member. In other words, latter cause depends on difference of thermal capacity of the members. The breakage due to the former does not depend on the size of the member. On the other hand, the breakage due to the latter, is determined by the sizes of the members, the ratio of materials with different thermal expansions included in the whole of the tube. In general, the large the tube size, the greater the influence.

Figure 5:
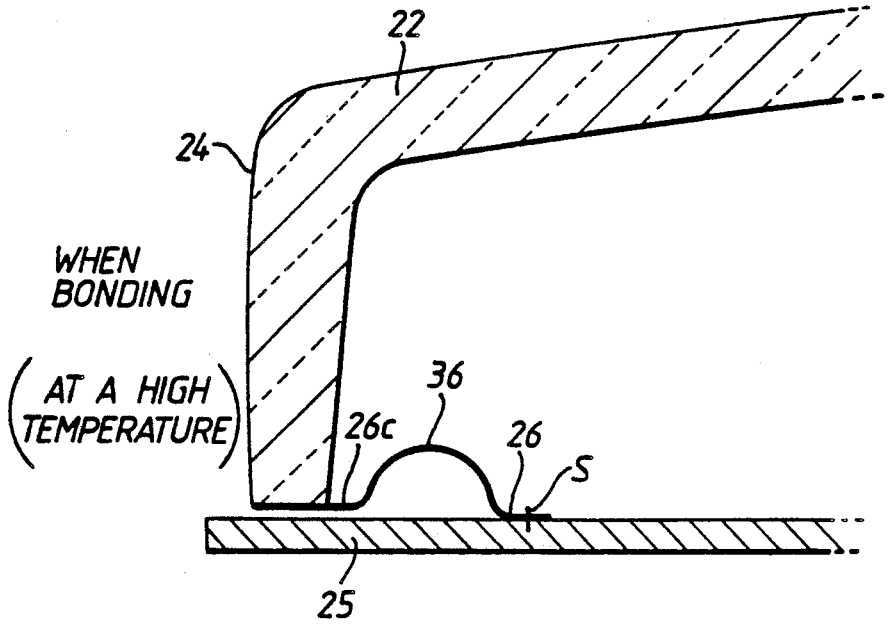
FIG. 5 shows a cross-sectional view of the first connecting member when connecting.
Figure 6:
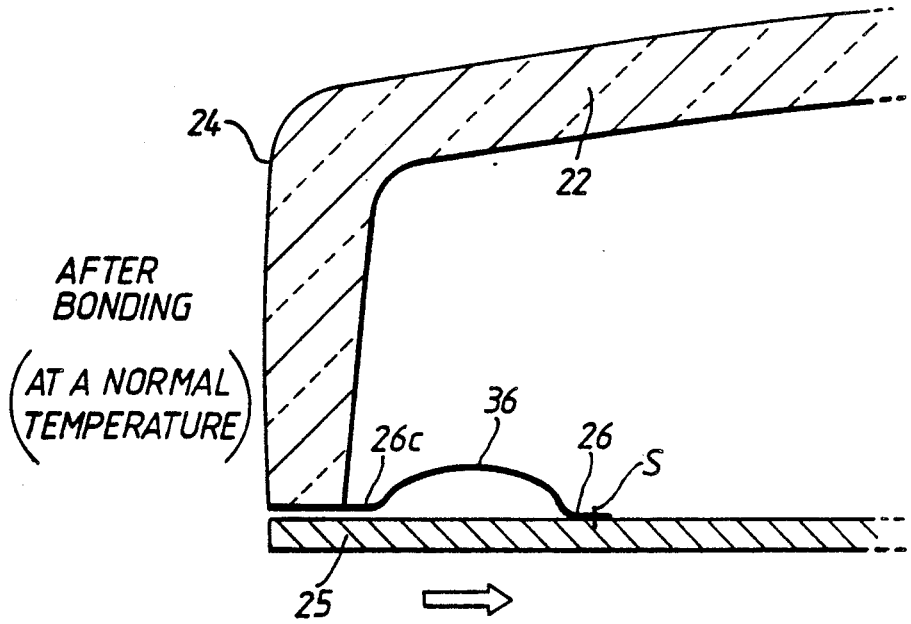
FIG. 6 shows a cross-sectional view of the first connecting means after connecting.

In the embodiment, the first connecting member 26 mentioned above can stabilize such strain caused by difference of thermal expansion amount by deformation of the projection 36. This mechanism is explained, in detail, with reference to FIGS. 5 and 6. As shown in FIG. 5 showing the condition of bonding by frit sealing, the projection 36 is not deformed when the first connecting member 26, which has been previously welded to the rear plate 25 at the point S, is bonded to the end of the skirt 24 by frit glass, since the frit glass is melted at high temperature. As shown in FIG. 6, when these members have reached normal temperature, since thermal expansion amount of the rear plate 25 is greater than that of the panel 22, the rear plate 25 thermally contracts inwards (in the direction of arrow).

As the thermal contraction, the projection 36 is deformed, as shown in FIG. 6, and absorbs the difference in thermal expansions of the panel 22 and the rear plate 25. When the projection 36 is deformed, the third flat portion 26*c* which isolates the projection 36 from the frit sealing portion is hardly deformed. The strain due to the thermal contracting is not transferred to the frit sealing portion. In consequence, the breakage of the panel by the thermal contraction of the rear plate 25 can be prevented.

As shown in FIG. 6, the skirt 24 is not directly sealed to the rear plate 25. However, since the skirt 24 is pressed against the rear plate 25 due to atmospheric pressure, the position of the skirt end is hard to be shifted on the rear plate 25.

In the embodiment mentioned above, the projection 36, which absorbs the strain caused by the difference in thermal expansion, is only provided on the first connecting member 26, but the second connecting member 28, which is ring-shaped plate, has no projection. Since the bonding surface of the funnel 27 and the second connecting member 28 is small and the difference in thermal expansion is also small, the strain, which breaks the funnel 27, does not occur.

When the second connecting member is required to have the projection due to increased bonding surface, the same effect can be obtained when projection is provided in the member as well.

In this embodiment, the cross-sectional shape of the projection 36 was formed in a semicircular shape. However, the projection 36 can be formed in any shape capable of expanding and contracting in order to absorb the strain caused by difference in thermal expansion amount by deformation. For example, it can be formed in an oval or triangular shapes.

The connecting member may have one or more projections. Also, the connecting member may be made of a sealing alloy of 52% nickel—6% chromium alloy.

It is preferable for the projection with a semicircular shape that the radius of the projection ranges from about 3 mm to 5 mm in the case of this embodiment. If it exceeds 5 mm, the projection will be crashed due to atmospheric pressure. The suitable size of the projection will be varied in accordance with the sizes of the tube and the connecting member.

It is also preferable for the projection that the projection is smoothly connected to both flat portion of the connecting member.

Although, in this embodiment, the member with a cross-sectional shape of "L" letter is used as the reinforcement plates 30*a*, 30*b* and 30*c* which are welded to the rear plate 25 by spot resistance welding, a flat-shaped member can be used as the reinforcement plates 30*a*, 30*b* and 30*c* when the plates 30*a*, 30*b* and 30*c* are welded by arc welding or plasma welding.

Also, regarding the positioning and number of the reinforcement plates, it is effective to provided the required number of the plates where the deformation of the rear plate due to atmospheric pressure is great.

Further, in the cathode ray tube shown in FIG. 2 and 3, a thin metal plate, which is reinforced against atmospheric pressure by the reinforcement plates 30*a*, 30*b* and 30*c*, is sued for the rear plate 25 to reduce weight of the envelope. However, the reinforcement plates can be omitted if the rear plate with a thickness of 8 mm is used, the reinforcement plate can be omitted since the deformation of the rear plate is extremely small.

Figure 7:
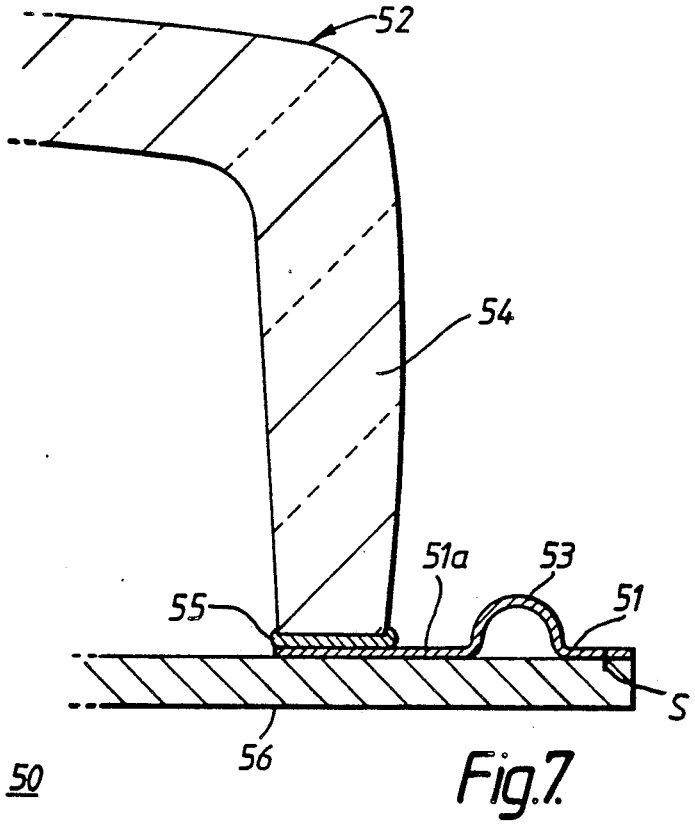
FIG. 7 shows a cross-sectional view of a part of a color cathode ray tube in accordance with another embodiment of the invention.

Another embodiment is explained with reference to FIG. 7. An envelope 50 of the cathode ray tube shown in FIG. 7 has a first connecting member 51 which is provided outside a panel 52. As same as the first connecting member previously explained, the connecting member 51 has a projection 53 surrounding the skirt 54 of the panel 52 and a solid portion 51*a* which is harder to be deformed than the projection 53 due to the strain caused by the difference between thermal expansion amount of the panel 52 and that of the rear plate 56. Also, the connecting member 51 is bonded to the end of the skirt 54 by a frit glass layer 55 at one end and is welded to the rear plate 56 at point S. Thus, the panel 52 of glass is hermetically connected to the rear plate 56 of metal through the first connecting member 51. The connecting member 51 can absorb the strain caused by the difference in thermal expansion amount of the panel 52 and the rear plate 56 by deformation of the projection 53.

Figure 8:
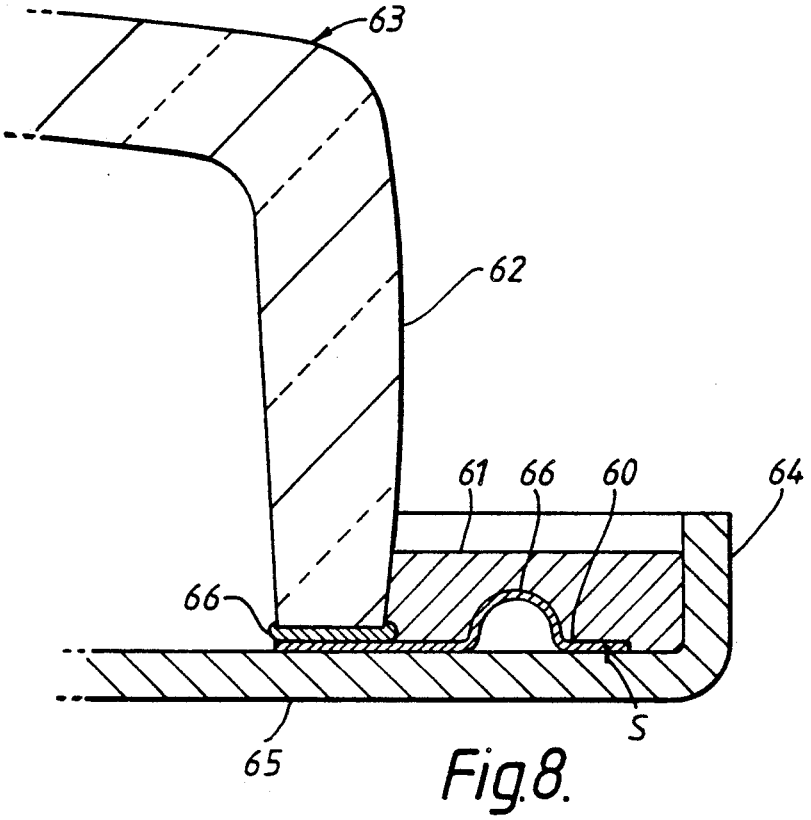
FIG. 8 shows a cross-sectional view of a part of a color cathode ray tube in accordance with another embodiment of the invention.

Since the first and second connecting member are part of the envelope, it is desirable for preventing the connecting members from getting rusty. Namely, as shown in FIG. 8, the first connecting member 60 is covered with a layer 61 of potting material filling the space between the wall of the skirt 62 of the panel 63 and a frange portion 64 of the rear plate 65 extending parallel to the wall of the skirt 62. Of course, the connecting member 60 has the projection 66 for absorbing the strain caused by the difference in thermal expansion amount of the panel 63 and the rear plate 65. Also, the connecting member 60 is bonded to the panel 63 by the frit glass layer 66 and is welded to the rear plate 65 at line of S.

Figure 9:
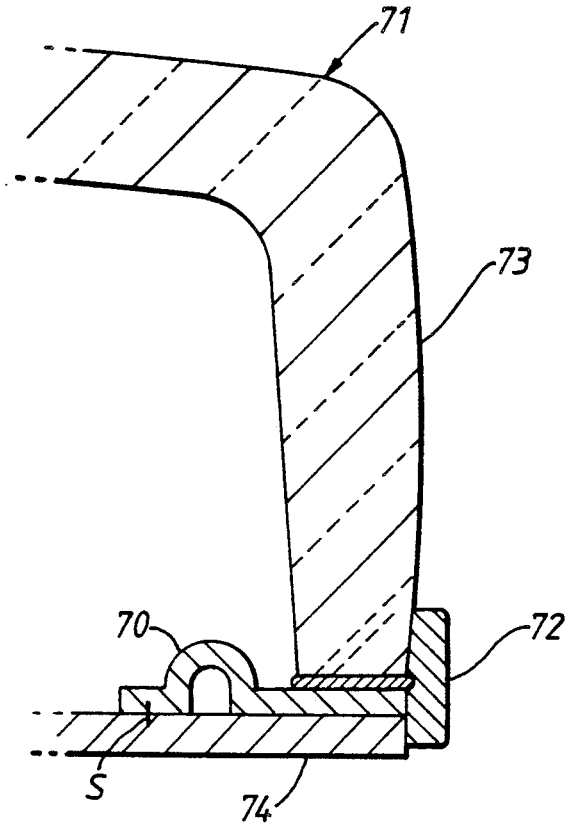
FIG. 9 shows a cross-sectional view a part of a color cathode ray tube in accordance with the other embodiment of the invention.

Also, if the first connecting member 70 is provided inside the panel 71, as shown in FIG. 9, a layer 72 of potting material can be provided so as to cover a space between the skirt 73 and the rear plate 74. The connecting member 70 is isolated from atmosphere by the layer 72 and is prevented from getting rusty.

For potting material, any material, which is normally used for potting, such as liquid resin and silicone rubber, may be used.

The envelope of the color cathode ray tube according to the embodiment is applicable for an envelope of monochromo cathode ray tube.

This invention may be applied to the display device in which the images are reproduced due to electron beam excitation of a phosphor screen composed of phosphor material.

What is claimed is:

1. A color cathode ray tube comprising:

a vacuum envelope including a panel having a single glass faceplate including an inner surface and central axis and a skirt extending from the faceplate, a rear metal plate hermetically connected to the skirt through a first connecting means, a plurality of funnels coupled to the rear plate through a second connecting means, and a plurality of necks respectively extending from the funnels, at least one of the first and second connecting means having stabilizing means for absorbing strain caused by difference between a thermal expansion amount of the rear plate and that of the panel and the difference between a thermal expansion amount of the rear plate and that of the funnel, respectively;

a plurality of electron gun assemblies respectively received in the necks for emitting a plurality of electron beams;

a screen formed on the inner surface of the faceplate for emitting visible light by excitation of the electron beams from the electron gun assemblies; and, a mask received in the vacuum envelope so as to face to the screen and having an effective region for allowing passage of the electron beams to impinge on the screen.

2. A color cathode ray tube according to claim 1 wherein the stabilizing means includes a deformable portion for absorbing the strain caused by the difference of thermal expansion amount.

3. A color cathode ray tube according to claim 1 wherein the stabilizing means includes a deformable portion for absorbing the strain caused by the difference of thermal expansion amount and a solid portion being harder to be deformed than the deformable portion due to the strain caused by the difference of thermal expansion amount.

4. A color cathode ray tube according to claim 2 wherein the deformable portion is placed inside the panel.

5. A color cathode ray tube according to claim 2 wherein the deformable portion is placed outside the panel.

6. A color cathode ray tube according to claim 2 wherein the deformable portion includes at least one projection projecting toward the direction perpendicular to the rear plate surface.

7. A color cathode ray tube according to claim 6 wherein a cross-sectional shape of the projection is a semicircular.

8. A color cathode ray tube according to claim 6 wherein a cross-sectional shape of the projection is triangular.

9. A color cathode ray tube according to claim 1 further comprising reinforcement means for reinforcing mechanical strength of the rear plate.

10. A color cathode ray tube according to claim 9 wherein the reinforcement means comprises a plurality of L-shaped metal plates.

11. A color cathode ray tube according to claim 5 further comprising sealing means for covering the deformable portion.

12. A color cathode ray tube according to claim 4 further comprising a sealing means for isolating the deformable portion form atmosphere.

13. A color cathode ray tube according to claim 11 wherein the sealing means comprises a flange extending from the rear plate in the direction perpendicular to the rear plate surface so as to surround the deformable portion and a sealing layer covering the deformable portion.

14. A vacuum envelope for a display device having a phosphor screen including phosphor material emitting visible light and beam source provide so as to face the phosphor screen for emitting electron beams to excite the phosphor material comprising:

a glass front section having an inner surface for forming the phosphor screen thereon, a rear section having a metal portion, a connection section having a first end hermetically sealed to the front section, a second end hermitically sealed to the metal portion of the rear section, and stabilizing means provided between the first and second ends and including a deformable portion for absorbing strain caused by difference between a thermal expansion amount of the front section and that of the rear section, and a solid portion provided between the first end and the deformable portion and being harder to be deformed than the deformable portion due to the strain caused by the difference of thermal expansion amount.

15. The vacuum envelope of claim 14 wherein the deformable portion includes at least one projection projecting toward the direction perpendicular to the rear section surface.

16. A vacuum envelope for a cathode ray tube having a plurality of electron gun assemblies for emitting a plurality of electron beams and a phosphor screen for emitting visible light in accordance with excitation of the electron beams comprising:

a panel having a single glass faceplate including an inner surface for supporting the phosphor screen and a skirt extending from the faceplate;

a rear metal plate hermetically connected to the skirt through a first connecting means;

a plurality of funnels hermetically connected to the rear plate through second connecting means; and a plurality of necks respectively extending from the funnels, for receiving the electron gun assemblies, respectively, at least one of the first and second connecting means having stabilizing means for absorbing strain caused by difference between thermal expansion amount of the rear plate and that of the panel and difference between thermal expansion amount of the rear plate and that of the funnel, respectively.

17. The vacuum envelope of claim 16 wherein the stabilizing means includes a deformable portion for absorbing the strain caused by the difference of thermal expansion amount, 18. The vacuum envelope of claim 16 wherein the stabilizing means includes a deformable portion for absorbing the strain caused by the difference of thermal expansion amount and a solid portion being harder to be deformed than the deformable portion due to the strain caused by the difference of the thermal expansion amount.

* * * * *